US009028296B2

(12) United States Patent
Venkatachalam et al.

(10) Patent No.: US 9,028,296 B2
(45) Date of Patent: May 12, 2015

(54) GLASS SHEETS AND METHODS OF SHAPING GLASS SHEETS

(75) Inventors: Siva Venkatachalam, Painted Post, NY (US); Liming Wang, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 236 days.

(21) Appl. No.: 13/599,090

(22) Filed: Aug. 30, 2012

(65) Prior Publication Data

US 2014/0065376 A1 Mar. 6, 2014

(51) Int. Cl.

| | |
|---|---|
| ***B24B 9/10*** | (2006.01) |
| ***B24B 7/26*** | (2006.01) |
| ***B24B 1/00*** | (2006.01) |
| ***B24B 47/22*** | (2006.01) |
| ***B24B 27/00*** | (2006.01) |
| ***B24B 7/24*** | (2006.01) |

(52) U.S. Cl.

CPC ..... *B24B 9/10* (2013.01); *Y10T 428/24777* (2015.01); *B24B 1/00* (2013.01); *B24B 47/225* (2013.01); *B24B 7/26* (2013.01); *B24B 27/0076* (2013.01); *B24B 9/107* (2013.01); *B24B 7/242* (2013.01)

(58) Field of Classification Search

CPC ..... B24B 1/00; B24B 9/10; B24B 9/107; B24B 7/242; B24B 7/26; B24B 47/225; B24B 27/0076

USPC ..... 451/44, 57, 58, 65, 70

See application file for complete search history.

(56) References Cited

U.S. PATENT DOCUMENTS

| | | | | | |
|---|---|---|---|---|---|
| 3,187,467 | A | * | 6/1965 | Cortesi | 451/151 |
| 3,894,361 | A | * | 7/1975 | Georgiadis et al. | 451/240 |
| 4,060,937 | A | * | 12/1977 | Glazer | 451/190 |
| 4,228,617 | A | * | 10/1980 | Bando | 451/5 |
| 4,375,738 | A | * | 3/1983 | Bando | 451/4 |
| 4,594,814 | A | * | 6/1986 | Olszewski et al. | 451/44 |
| 4,908,996 | A | * | 3/1990 | Friedman et al. | 451/43 |
| 5,295,331 | A | * | 3/1994 | Honda et al. | 451/44 |
| 5,371,974 | A | * | 12/1994 | Lecerf et al. | 451/5 |

(Continued)

FOREIGN PATENT DOCUMENTS

| | | |
|---|---|---|
| JP | 07-186022 | 7/1995 |
| JP | 11-077500 | 3/1999 |

(Continued)

OTHER PUBLICATIONS

PCT Application No. PCT/US2013/056767, Filed Aug. 27, 2013, Dec. 23, 2013 International Search Report.

*Primary Examiner* — Eileen Morgan

(74) *Attorney, Agent, or Firm* — Ryan T. Hardee

(57) ABSTRACT

Methods of shaping a glass sheet each include a step of removing a first portion of the glass sheet to form a first beveled surface. The methods further include the step of removing a second portion of the glass sheet to form a second beveled surface. The methods still further include the step of removing a third portion of the glass sheet comprising a remainder of an end surface of an edge portion of the glass sheet. In further examples, glass sheets are also provided with a first bevel surface intersecting a first glass-sheet surface and an apex surface, and a second bevel surface intersecting a second glass-sheet surface and the apex surface. The glass sheet exhibits a probability of failure of less than 5% at an edge stress of 135 MPa.

15 Claims, 10 Drawing Sheets

(56) References Cited

U.S. PATENT DOCUMENTS

| | | | | |
|---|---|---|---|---|
| 6,325,704 | B1 | 12/2001 | Brown et al. | 451/44 |
| 6,676,488 | B2 | 1/2004 | Brown et al. | 451/41 |
| 6,685,541 | B2 * | 2/2004 | Brown et al. | 451/41 |
| 7,001,249 | B1 * | 2/2006 | Pride et al. | 451/21 |
| 7,018,272 | B2 | 3/2006 | Allaire et al. | 451/11 |
| 7,094,128 | B2 * | 8/2006 | Vianello et al. | 451/5 |
| 8,241,091 | B2 * | 8/2012 | Takeichi | 451/5 |
| 8,721,392 | B2 * | 5/2014 | Brown et al. | 451/44 |
| 8,784,157 | B2 * | 7/2014 | Bando | 451/5 |
| 2004/0259475 | A1 * | 12/2004 | Vianello et al. | 451/5 |
| 2010/0197198 | A1 * | 8/2010 | Takeichi | 451/5 |
| 2011/0021116 | A1 * | 1/2011 | Brown et al. | 451/44 |
| 2011/0107894 | A1 * | 5/2011 | Maekawa et al. | 83/869 |
| 2013/0267151 | A1 * | 10/2013 | Bando | 451/69 |

FOREIGN PATENT DOCUMENTS

| | | |
|---|---|---|
| JP | 2006-026845 | 2/2006 |
| KR | 10-1155902 | 6/2012 |

* cited by examiner

GLASS SHEETS AND METHODS OF SHAPING GLASS SHEETS

TECHNICAL FIELD

The present disclosure relates generally to glass sheets and methods of shaping glass sheets and, more particularly, to glass sheets with an edge portion including first and second bevel surfaces and methods of shaping glass sheets by removing first and second portions to form respective first and second bevel surfaces.

BACKGROUND

The process of manufacturing glass sheets, including glass sheets for use in liquid crystal displays, typically involves melting of raw material, forming a glass sheet therefrom, and then finishing the glass sheet. The finishing operation, in turn, frequently involves cutting the glass sheet to size, edge finishing, cleaning and packaging.

SUMMARY

The following presents a simplified summary of the disclosure in order to provide a basic understanding of some example aspects described in the detailed description.

In one aspect, a method of shaping a glass sheet is disclosed herein. The glass sheet includes a first glass-sheet surface, a second glass-sheet surface opposing the first glass-sheet surface, a thickness defined between the first glass-sheet surface and the second glass-sheet surface, and an edge portion including an end surface including a median crack surface. The first glass-sheet surface and the end surface intersect along a first edge of the edge portion. The second glass-sheet surface and the end surface intersect along a second edge of the edge portion. The median crack surface extends from either the first or second edge of the edge portion along the end surface. The method includes a step (I) of removing a first portion of the glass sheet including the first edge with at least one rotating cup wheel, thereby forming a first bevel surface between the first glass-sheet surface and the end surface. The method also includes a step (II) of removing a second portion of the glass sheet including the second edge with the at least one rotating cup wheel, thereby forming a second bevel surface between the second glass-sheet surface and the end surface. The method then includes a step (III) of removing a third portion of the glass sheet including the remainder of the end surface with a rotating grooved wheel to form an apex surface between the first and second bevel surfaces. In accordance with the method, step (I) and/or step (II) removes the median crack surface.

In one example of the aspect, steps (I), (II) and (III) provide the glass sheet with a shaped edge that exhibits a probability of failure of less than 5% at an edge stress of 135 MPa.

In another example of the aspect, steps (I) and (II) are conducted simultaneously.

In still another example of the aspect, the at least one rotating cup wheel of step (I) comprises a first rotating cup wheel and the at least one rotating cup wheel of step (II) comprises a second rotating cup wheel.

In another example aspect, the at least one rotating cup wheel is selected from the group consisting of a metal bond diamond wheel and a resin bond diamond wheel.

In a further example aspect, the bonded diamond wheel includes a mesh size ranging from 400 to 1000.

In still another example aspect, the grooved wheel is a metal bond wheel with a diamond mesh size ranging from 600 to 1000.

In yet another example aspect, the grooved wheel comprises a groove configured to accommodate a profile of the glass sheet defined by the first bevel surface, the apex surface, and the second bevel surface.

In a further example of the aspect, after step (III), further comprising the step (IV) of contacting the glass sheet with a rotating polish wheel to polish at least one of the first bevel surface, the apex surface, and the second bevel surface.

In yet a further example of the aspect, after step (III), further comprising the step (IV) of providing a rounded intersection between at least one of the first glass-sheet surface and the first bevel surface, the first bevel surface and the apex surface, the apex surface and the second bevel surface, and the second bevel surface and the second glass-sheet surface.

In another example of the aspect, after step (III), further comprising the step (IV) of contacting the glass sheet with a rotating polish wheel including a wheel body selected from the group consisting of a rubber bond wheel, a resin bond wheel, and a polymer bond wheel and a cutting material selected from the group consisting of one or more of a diamond grit, a silicon carbide grit, an alumina grit and a ceria grit.

In yet another example of the aspect, the median crack surface extends less than or equal to 15% of the thickness of the glass sheet.

In another example of the aspect, a shaped edge is made in accordance with the aspect, wherein the glass sheet comprising the shaped edge exhibits a probability of failure of less than 5% at an edge stress of 135 MPa.

In another aspect, a method of shaping a glass sheet is disclosed herein. The glass sheet includes a first glass-sheet surface, a second glass-sheet surface opposing the first glass-sheet surface, a thickness defined between the first glass-sheet surface and the second glass-sheet surface, and an edge portion including an end surface including a median crack surface. The first glass-sheet surface and the end surface intersect along a first edge of the edge portion. The second glass-sheet surface and the end surface intersect along a second edge of the edge portion. The median crack surface extends from either the first or second edge of the edge portion along the end surface. The method includes a step (I) of removing a first portion of the glass sheet including the first edge, thereby forming a first bevel surface between the first glass-sheet surface and the end surface. The method also includes a step (II) of removing a second portion of the glass sheet including the second edge, thereby forming a second bevel surface between the second glass-sheet surface and the end surface. The method then includes a step (III) of removing a third portion of the glass sheet including the remainder of the end surface, thereby forming an apex surface between the first and second bevel surfaces. In accordance with the method, step (I) and/or step (II) removes the median crack surface.

In one example of the aspect, steps (I), (II) and (III) provide the glass sheet with a shaped edge that exhibits a probability of failure of less than 5% at an edge stress of 135 MPa.

In another example of the aspect, steps (I) and (II) are conducted simultaneously.

In yet a further example of the aspect, step (I) and/or step (II) includes chamfering with at least one rotating cup wheel.

In still a further example of the aspect, step (III) includes removing the third portion with a rotating grooved wheel.

In another example of the aspect, a shaped edge is made in accordance with the aspect, wherein the glass sheet comprising the shaped edge exhibits a probability of failure of less than 5% at an edge stress of 135 MPa.

In a further aspect, a glass sheet comprises a first glass-sheet surface and a second glass-sheet surface opposing the first glass-sheet surface with a thickness defined between the first glass-sheet surface and the second glass-sheet surface. The glass sheet further includes an edge portion including a first bevel surface intersecting the first glass-sheet surface and an apex surface, and a second bevel surface intersecting the second glass-sheet surface and the apex surface. The glass sheet exhibits a probability of failure of less than 5% at an edge stress of 135 MPa.

BRIEF DESCRIPTION OF THE DRAWINGS

These and other aspects are better understood when the following detailed description is read with reference to the accompanying drawings, in which.

DETAILED DESCRIPTION

Figure 1:
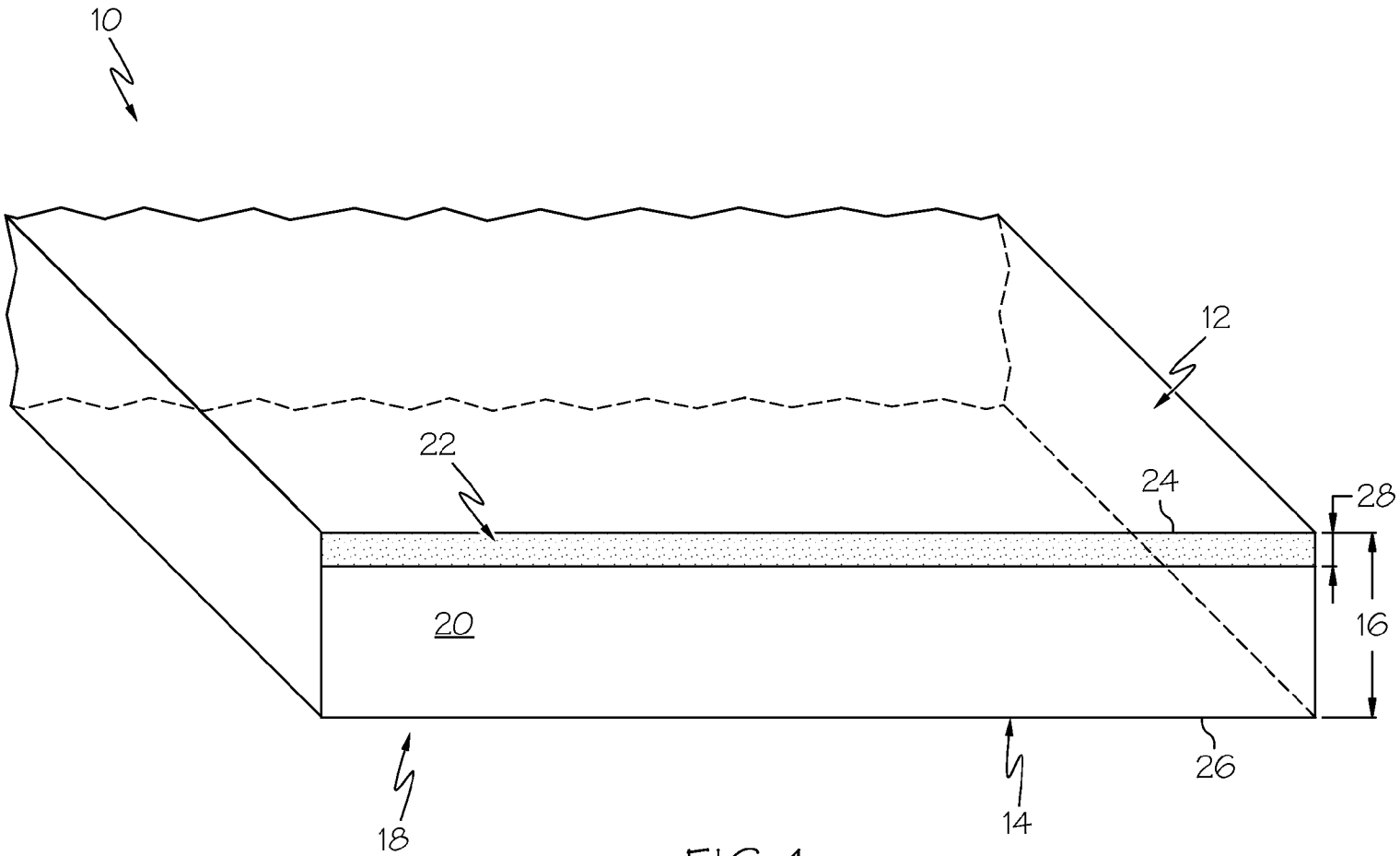
FIG. 1 is a schematic perspective view of part of an example glass sheet.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Example methods of the disclosure will be described with initial reference to the glass sheet 10 illustrated in FIG. 1. The glass sheet 10 can include a first glass-sheet surface 12, a second glass-sheet surface 14 opposing the first glass-sheet surface 12, a thickness 16 defined between the first glass-sheet surface 12 and the second glass-sheet surface 14. The glass sheet 10 further includes an edge portion 18 including an end surface 20 with a median crack surface 22. The glass sheet 10 can be, for example, a glass sheet 10 that has been initially cut to size by a process including scoring, such as mechanical scoring, laser scoring, or the like, followed by separation. The edge quality of a glass sheet 10 can be important for determining whether the glass sheet 10 can be used in a variety of applications, e.g. for incorporation in a liquid crystal display. Moreover, enhancing the edge quality can be desired to reduce the probability of crack failure under predetermined levels of edge stress. As such, enhancing edge quality can also increase the strength of the edge portion of the glass sheet and thereby avoid crack failure in the glass sheet under certain edge stress conditions. Accordingly, it may be desired to machine an edge portion of a glass sheet 10 to control, modify, and/or improve the edge quality thereof.

Considering the glass sheet 10 in more detail, as shown in FIG. 1 the first glass-sheet surface 12 and the end surface 20 can intersect along a first edge 24 of the edge portion 18 and the second glass-sheet surface 14 and the end surface 20 can intersect along a second edge 26 of the edge portion 18. The median crack surface 22 can extend from one or both of the first and second edge 24, 26. For example, as shown for illustration purposes, the median crack surface 22 is illustrated as extending from the first edge 24. In further examples, the median crack surface can extend from the second edge. In still further examples, the median crack surface can extend from both the first and second edge 24, 26.

The median crack surface 22 can be formed during the scoring and separation of a glass sheet 10, with the depth 28, and thus extent, of the median crack surface 22 being determined at least in part based on how these processes are carried out. Typically, the depth 28 of the median crack surface 22 depends on the thickness 16 of the glass sheet 10 being scored and is about 10% to 15% of the thickness 16. Glass sheets for incorporation in a liquid crystal display typically have a thickness of 2 mm or less, e.g. 0.7 mm or less, 0.5 mm or less, or 0.3 mm or less. Thus, for example, the median crack surface 22 can extend from either the first or second edge 24 or 26 of the edge portion 18, along the end surface 20, less than or equal to 15% of the thickness 16 of the glass sheet 10, e.g. extending less than or equal to 0.3 mm for a glass sheet 10 with a thickness 16 of 2 mm.

The median crack surface 22 that may be generated by way of mechanical scoring or other process can decrease the edge quality of the glass sheet 10, provide initial crack locations that may undesirably propagate to cause crack failure or other undesirable characteristics. Thus, removal of the median crack surface 22 from the glass sheet 10 may be desired. As discussed below, the median crack surface 22 can be removed by subsequent shaping steps, with the depth 28 of the median crack surface 22 determining the amount of glass material that can be removed in order to accomplish removal of the median crack surface 22.

The glass sheet 10 can also be free of lateral cracks along the edge portion 18. Like the median crack surface 22, lateral cracks can be formed during the scoring and separation of a glass sheet 10 and can decrease the edge quality of the glass sheet 10 and likewise increase the probability of crack failure under edge stress conditions. Accordingly, an absence of lateral cracks may also be desired.

Figure 2:
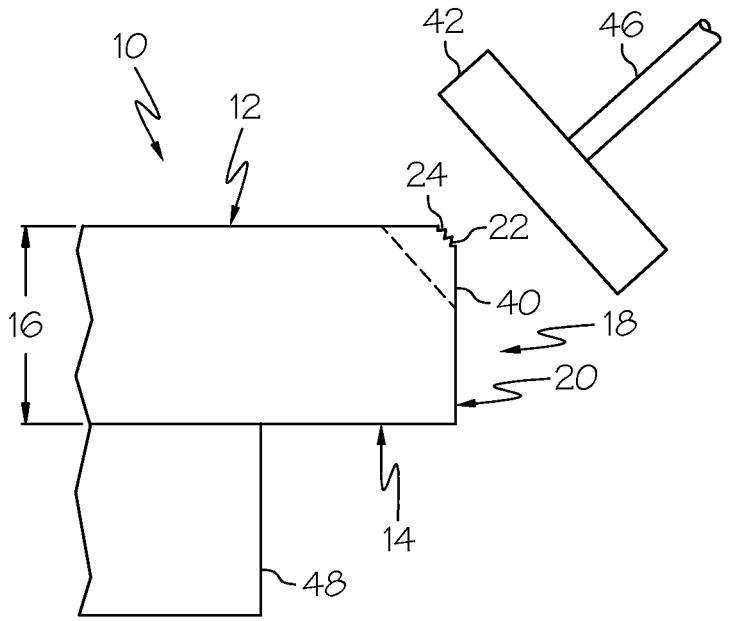
FIG. 2 is a schematic side view of part of an example glass sheet before removal of a first portion of the glass sheet by a rotating cup wheel.
Figure 3:
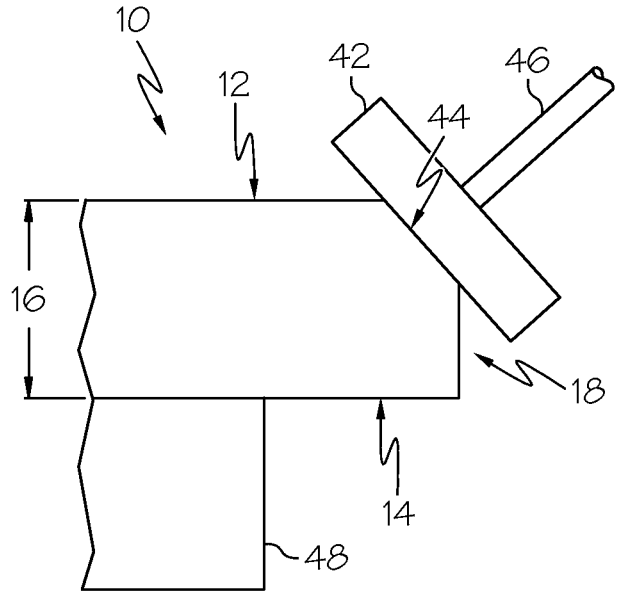
FIG. 3 is another schematic side view of the part of the example glass sheet of FIG. 2 upon removal of the first portion of the glass sheet by the rotating cup wheel to form a first bevel surface.
Figure 4:
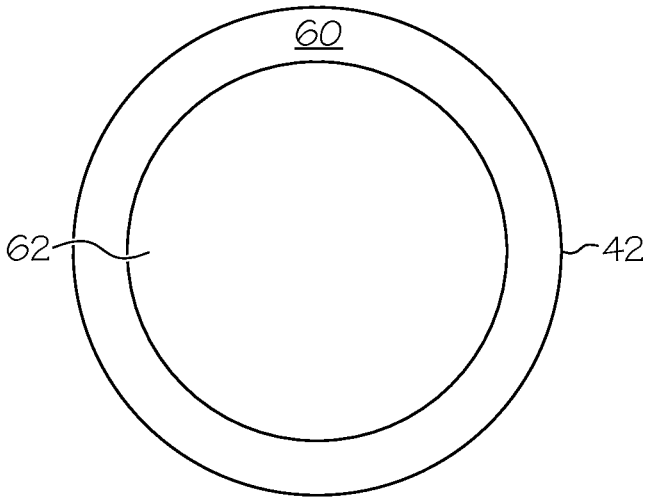
FIG. 4 is a bottom schematic view of portions of an example rotating cup wheel.
Figure 5:
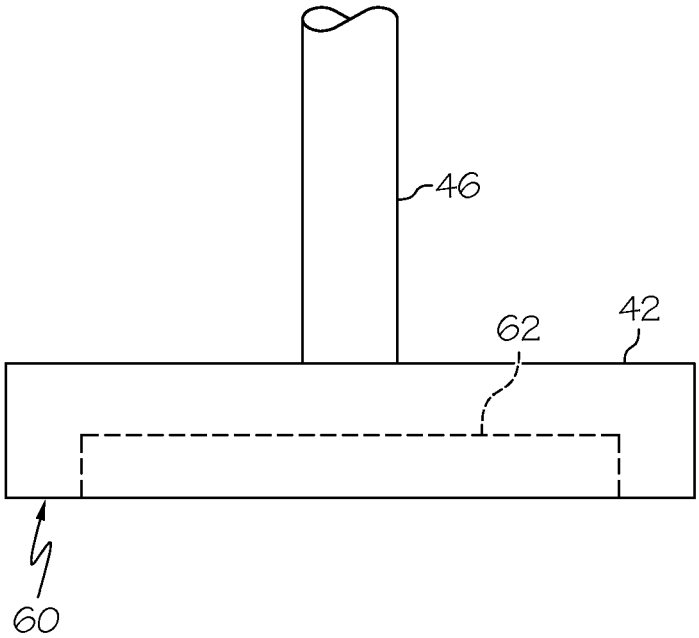
FIG. 5 is a side schematic view of portions of the example rotating cup wheel of FIG. 4.

Considering now the method of shaping the glass sheet 10, the method can include a step (I) of removing a first portion 40 of the glass sheet 10 including the first edge 24 with at least one rotating cup wheel 42. As shown in FIGS. 2-3, removing the first portion 40 of the glass sheet 10 can form a first bevel surface 44, between the first glass-sheet surface 12 and the end surface 20. As shown in FIGS. 4-5, a cup wheel 20 can comprise a grinding wheel that includes an outer annular surface 60 and a recessed center 62. The outer annular surface 60 is abrasive and thus can be used as a grinding surface. The recessed center 62 provides an open configuration that allows for free flow of ground glass away from the glass sheet 10 during grinding. The at least one rotating cup wheel 42 can be, for example, a bonded diamond wheel, such as a metal bond diamond wheel or a resin bond diamond wheel. Such a bonded diamond wheel can include a mesh size ranging from, for example, 400 to 1000, e.g. a 600 mesh size. As shown in FIG. 2, the at least one rotating cup wheel 42 can be mounted on a spindle 46, e.g. a rotatable shaft of an electric motor, and angled with respect to the glass sheet 10 so as to control the angle of the first bevel surface 44. The glass sheet 10 can be maintained in position, for example, by being secured in a support device 48 such as a chuck, air bearing or the like, so that the at least one rotating cup wheel 42 can contact the edge portion 18 of the glass sheet 10. Other approaches for maintaining the glass sheet 10 in position would also be suitable.

Figure 6:
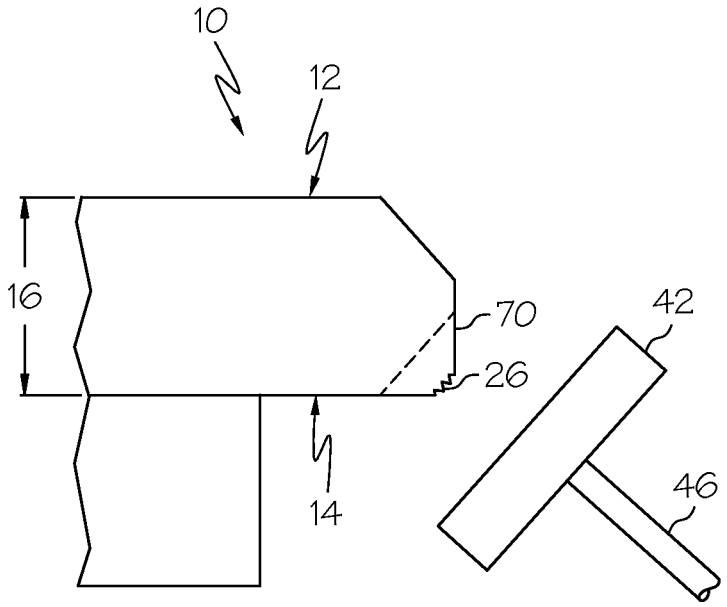
FIG. 6 is another schematic side view of the part of the example glass sheet of FIG. 3 before removal of a second portion of the glass sheet by the rotating cup wheel.
Figure 7:
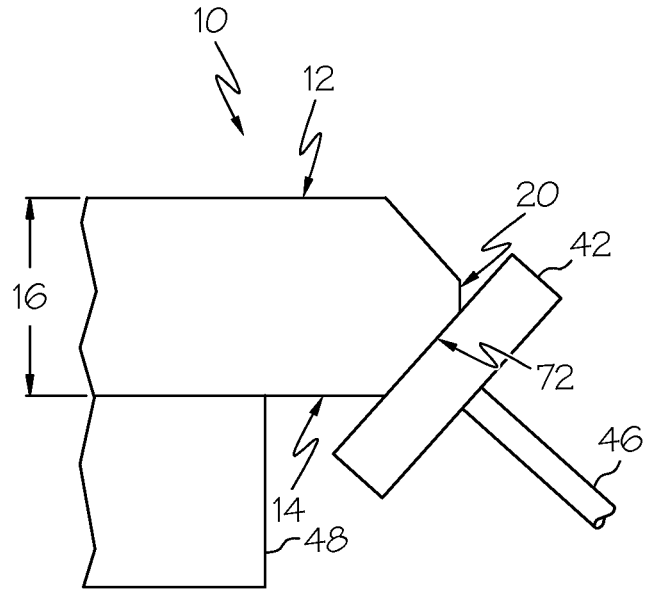
FIG. 7 is another schematic side view of the part of the example glass sheet of FIG. 6 upon removal of the second portion of the glass sheet by the rotating cup wheel to form a second bevel surface.

As shown in FIGS. 6-7, the method can also include a step (II) of removing a second portion 70 of the glass sheet 10 including the second edge 26 with the at least one rotating cup wheel 42, thereby forming a second bevel surface 72 between the second glass-sheet surface 14 and the end surface 20. The at least one rotating cup wheel 42 of step (II) also can be, for example, a bonded diamond wheel, e.g. including a mesh size ranging from 400 to 1000, and also can be mounted on a spindle 46 and angled with respect to the glass sheet 10 so as to control the angle of the second bevel surface 72, again with the glass sheet 10 maintained in position.

Considering steps (I) and (II) in more detail, the steps can be carried out to remove flaws and/or defects caused by scoring. The steps can also be carried out to provide the first and second bevel surfaces 44 and 72 in smooth forms and/or free of particles, such as glass chips. Various factors, such as the length of the glass sheet 10 that is available for contact by the at least one rotating cup wheel 42, the force applied thereby, the thickness 16 of the glass sheet 10, and the material properties of the glass sheet 10, can be varied or optimized toward these ends.

Figure 8:
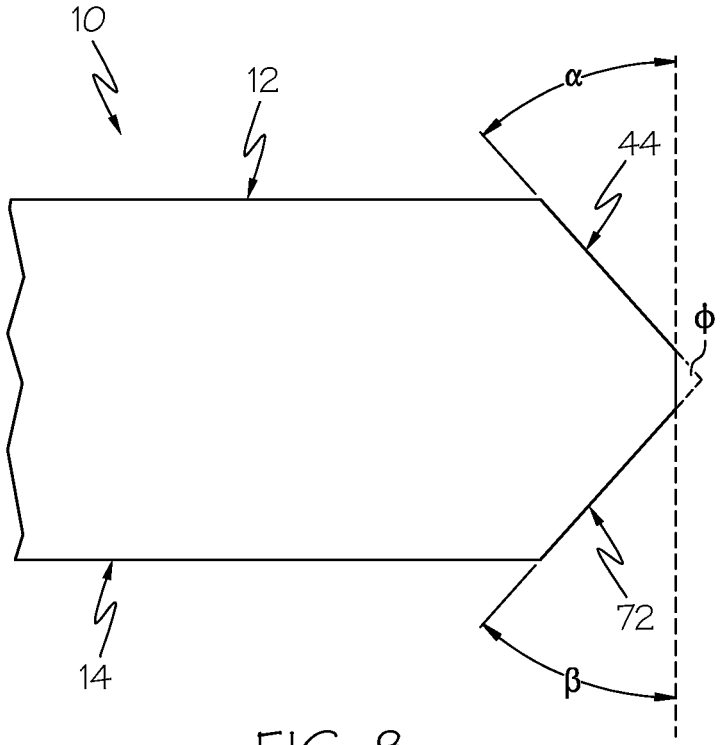
FIG. 8 is a schematic side view of the part of the example glass sheet including the first bevel surface and the second bevel surface.

Steps (I) and (II) can be carried out, for example, wherein the at least one rotating cup 42 of step (I) and the at least one rotating cup 42 of step (II) are angled with respect to the glass sheet 10 so as to form the first and second bevel surfaces 44 and 72 with a chamfer angle $\phi$ of, e.g. to 40° to 140°, e.g. 50° to 70°, or about 60° therebetween, as shown in FIG. 8. This can be accomplished, for example, by angling the at least one rotating cup wheel 42 of step (I) so as to generate the first bevel surface 44 at an angle $\alpha$ of 20° to 70°, e.g. 55° to 65°, or about 60°, with respect to the edge portion 18 of the glass sheet 10, and likewise angling the at least one rotating cup wheel 42 of step (II) so as to generate the second bevel surface 72 at an angle $\beta$ of 20° to 70°, e.g. 55° to 65°, or about 60°, with respect to the edge portion 18 of the glass sheet 10. As shown the angles $\alpha$ and $\beta$ can be substantially equal to one another although the angles may be different in further examples.

Figure 9:
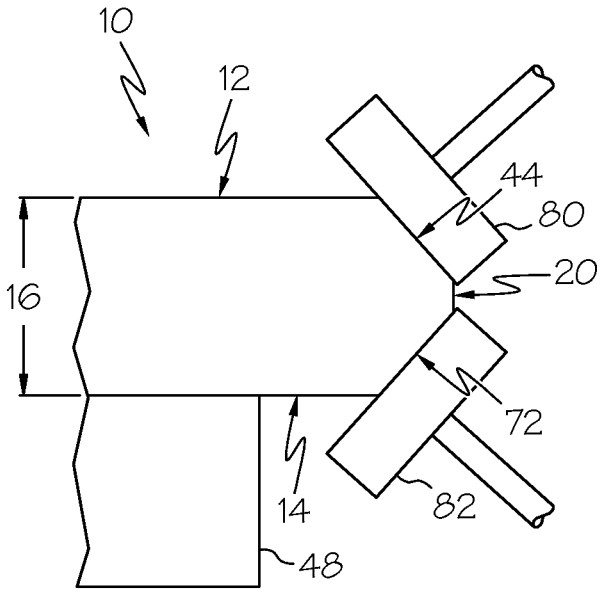
FIG. 9 is a schematic side view of the part of the example glass sheet similar to FIG. 2 upon simultaneous removal of first and second portions of the glass sheet by first and second rotating cup wheels to form first and second bevel surfaces.

Steps (I) and (II) can be carried out in various orders, e.g. simultaneously, sequentially, or in reverse order, as desired, and with one or more rotating cup wheels 42, also as desired. Thus, as shown in FIG. 9, for example, steps (I) and (II) can be conducted simultaneously, wherein the at least one rotating cup wheel 42 of step (I) can include a first rotating cup wheel 80 and the at least one rotating cup wheel 42 of step (II) can include a second rotating cup wheel 82. Also for example, steps (I) and (II) can be carried out sequentially, e.g. wherein the at least one rotating cup wheel 42 of step (I) can include a first rotating cup wheel 80 and the at least one rotating cup wheel of step (II) can include a second rotating cup wheel 82, or wherein the at least one rotating cup wheel 42 of step (II) is the same as that of step (I). Also for example, steps (I) and (II) can be carried out in reverse order.

Figure 10:
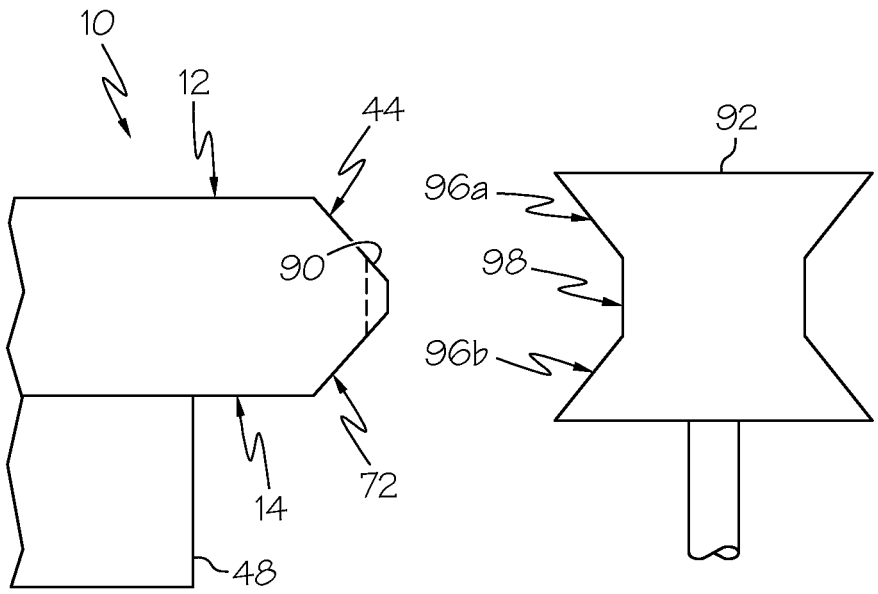
FIG. 10 is a schematic side view of the part of the example glass sheet of FIG. 8 before removal of a third portion of the glass sheet by a rotating grooved wheel.
Figure 11:
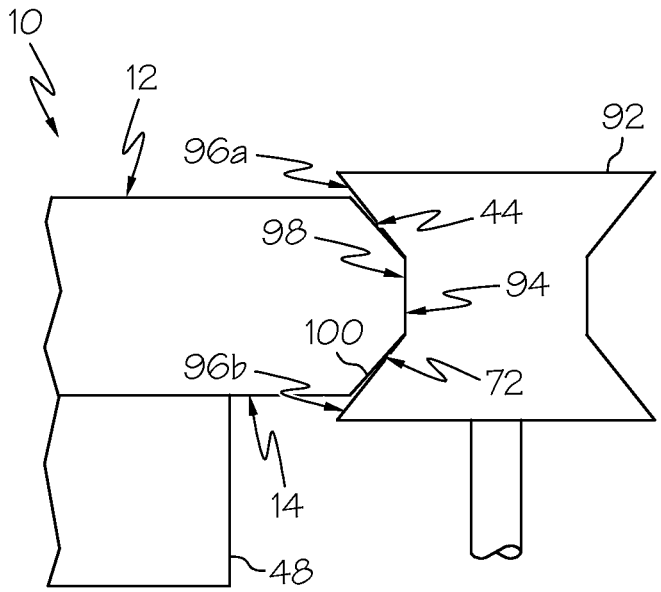
FIG. 11 is a schematic side view of the part of the example glass sheet of FIG. 10 upon removal of the third portion of the glass sheet by the rotating grooved wheel to form an apex surface.

Following steps (I) and (II), the method also includes then a step of (III) removing a third portion 90 of the glass sheet 10 including the remainder of the end surface 20 with a rotating grooved wheel 92 to form an apex surface 94 between the first and second bevel surfaces 44 and 72, as shown in FIGS. 10-11. A grooved wheel 92 is a grinding wheel that includes an edge 96 with an abrasive surface 98 in a recessed surface therein. The rotating grooved wheel 92 can be, for example, a metal bond wheel or the like, and can have a diamond mesh size ranging from, for example, 600 to 1000, e.g. 600 or 800 mesh size. The rotating grooved wheel 92 also can be, for example, a formed groove wheel, such that the edge 96 of the wheel 92 has a profile that is approximately complementary to, e.g. slightly wider than, the profile desired for the edge 100 of the glass sheet 10. A formed groove wheel 92 having such a profile can accommodate the edge 100 of the glass sheet 10 after steps (I) and (II). This can help in clearing ground glass away from the glass sheet 10 during grinding. The removal of material from the glass sheet 10 can also be minimized relative to beveling steps in other edge finishing processes.

Considering step (III) in more detail, the step can be carried out to remove a minimal amount of the glass sheet 10 necessary to form the apex surface 94. This step can also be carried out to provide the glass sheet 10 with a desired profile for the glass sheet 10 defined by the first bevel surface 44, the apex surface 94, and the second bevel surface 72, e.g. to provide a desired shape and/or ensure optimal quality for the glass sheet 10 with respect to a variety of applications. Various factors, such as the chamfer angle $\phi$ of the glass sheet 10 following steps (I) and (II), the final shape that is desired for the edge 100 of the glass sheet 10, and the amount of material to be removed from the glass sheet 10, can be varied or optimized toward these ends.

Step (III) can be carried out, for example, without removing material from the first or second bevel surface 44 or 72, e.g. without removing material other than the third portion 90 of the glass sheet 10 including the remainder of the end surface 20. Thus, for example, the grooved wheel 92 can include a groove that is sufficiently wide to accommodate a profile of the glass sheet 10 defined by the first bevel surface 44, the apex surface 94, and the second bevel surface 72. Suitable exemplary groove shapes include (i) groove height=0.762 mm, groove base width=0.3048 mm±0.0254 mm, R=0.127 mm±0.0254 mm, and groove angle of 80'; (ii) groove height=0.762 mm, groove base width=0.3556 mm±0.0254 mm, R=0.127 mm±0.0254 mm, and groove angle of 60°; and (iii) groove height=0.254 mm and R=0.508 mm±0.0254 mm. As will be appreciated, a grooved wheel 92 with a groove dimensioned to accommodate the profile of the glass sheet 10 can be used to remove the third portion 90 of the glass sheet 10 with precision, by contacting the grooved wheel 92 to the third portion 90 of the glass sheet 10 and advancing the wheel 92 toward the glass sheet 10, without any surface of the grooved wheel 92 contacting the first or second bevel surface 44 or 72 and thus without removing material from either.

Figure 12:
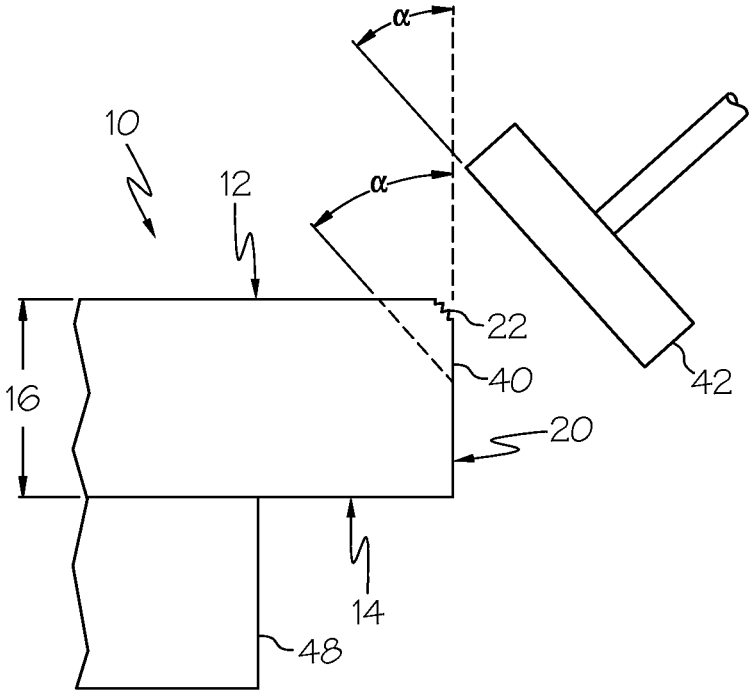
FIG. 12 is a schematic side view of part of an example glass sheet before removal of a first portion of the glass sheet, including a median crack region, by a rotating cup wheel.
Figure 13:
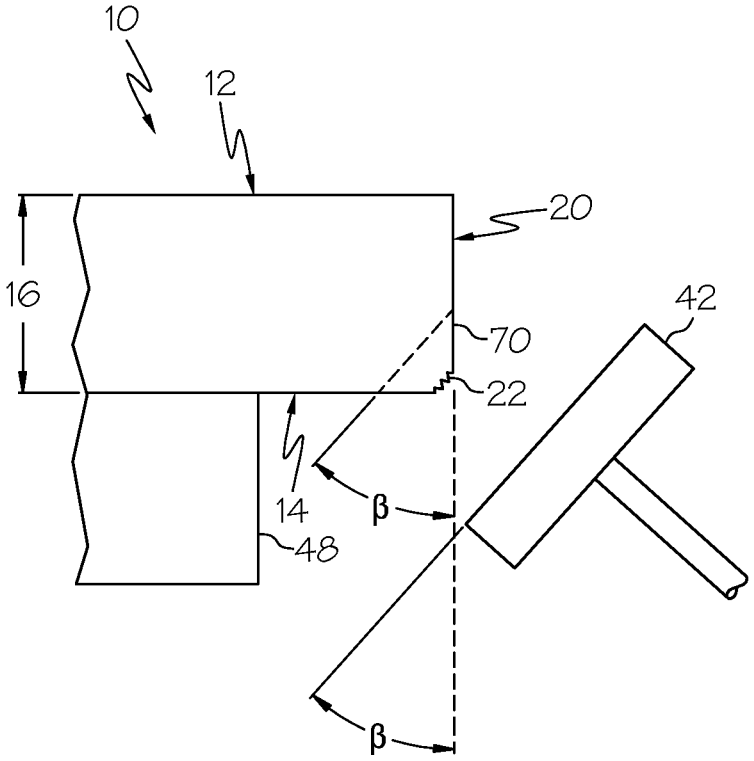
FIG. 13 is a schematic side view of part of an example glass sheet before removal of a second portion of the glass sheet, including a median crack region, by a rotating cup wheel.

In accordance with the method, step (I) and/or step (II) can remove the median crack surface 22, as shown in FIGS. 12-13. For example, step (I) can remove the median crack surface 22 to the extent that the median crack surface 22 is contained in the first portion 40 of the glass sheet 10 that is removed during step (I). Similarly, step (II) can remove the median crack surface 22 to the extent that the median crack surface 22 is contained in the second portion 70 of the glass sheet 10 that is removed during step (II). As will be appreciated, removal of the median crack surface 22 by step (I) and/or step (II) can be ensured by determining the depth 28 of the median crack surface 22 of the glass sheet 10 and then carrying out step (I) and/or step (II) with the at least one rotating cup wheel 42 thereof angled with respect to the glass sheet 10 so ensure removal of the median crack surface 22 during formation of the first and/or second bevel surface 44 or 72.

The combination of steps (I), (II), and (III) allows a reduction in the amount of material to be removed from glass sheets, relative to other edge finishing processes, based on reduced depths of cutting. This in turn allows the use of cup wheels and grooved wheels with relatively finer grit, at potentially higher glass traverse speeds, providing better edge strength and quality. The reduction in the amount of material removed is calculated to be about 1:1.8-2.4, or in other words an approximately 2 fold reduction. This eliminates about half of the volume of ground glass and other debris.

Figure 14:
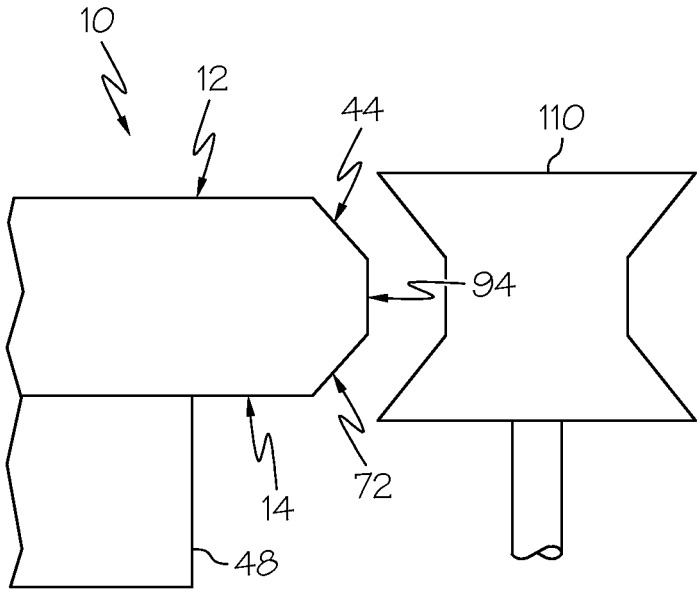
FIG. 14 is a schematic side view of part of an example glass sheet before polishing by a rotating polish wheel.
Figure 15:
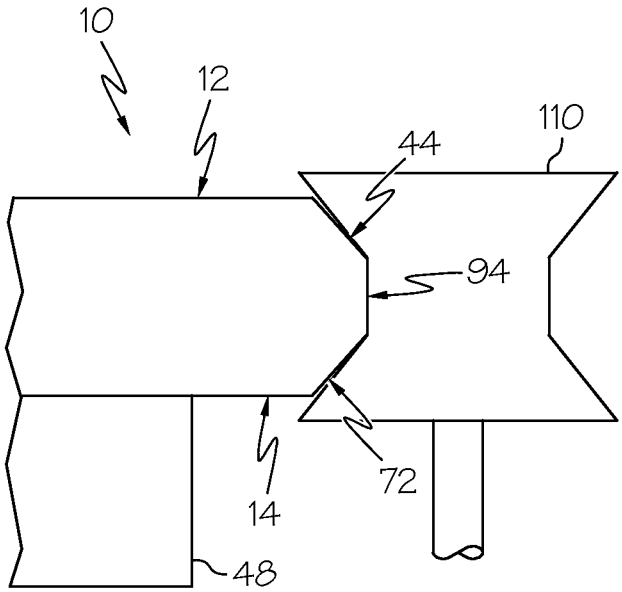
FIG. 15 is a schematic side view of the part of the example glass sheet of FIG. 14 upon polishing by the rotating polish wheel.

Following step (III), the method can also include then a step of (IV) contacting the glass sheet 10 with a rotating polish wheel 110 at one or more surfaces of the edge 100 of the glass sheet 10 and/or between one or more of the surfaces, as shown in FIGS. 14-15. The polish wheel 110 can include, for example, a wheel body such as a rubber bond wheel, a resin bond wheel, a polymer bond wheel, or the like. The polish wheel 110 can also include a cutting material such as a diamond grit, a silicon carbide grit, an alumina grit, a ceria grit, or another similar cutting material. Thus, for example, step (IV) can include contacting the glass sheet 10 with a rotating polish wheel 110 to polish at least one of the first bevel surface 44, the apex surface 94, and the second bevel surface 72. This can be done, for example, to impart a desired finish quality to the edge 100 of the glass sheet 10 at one or more of these surfaces. Also for example, step (IV) can include providing a rounded intersection between at least one of the first glass-sheet surface 12 and the first bevel surface 44, the first bevel surface 44 and the apex surface 94, the apex surface 94 and the second bevel surface 72, and the second bevel surface 72 and the second glass-sheet surface 14. This can be done, for example, to round any sharp corners, which otherwise could be easily damaged, between the surfaces.

The method can be performed in various configurations, such as an assembly-line style set-up, a modular type set-up, or other similar set-ups. For example, for an assembly-line style set-up, the glass sheet 10 can be fixed in a support device 48 and moved along the assembly line, e.g. at a constant rate. A first rotating cup wheel 80 can be inclined at a desired angle with respect to the glass sheet 10 and used to grind the glass sheet 10 to remove the first portion 40 thereof, including the first edge 24, as the glass sheet 10 passes, to form the first bevel surface 44. A second rotating cup wheel 82 can be similarly inclined at a desired angle and used to grind the glass sheet 10 to remove the second portion 70 thereof, including the second edge 26, as the glass sheet 10 passes, to form the second bevel surface 72. The order of formation of the first and second bevel surfaces 44 and 72 can also be interchanged. The rotating grooved wheel 92 can be oriented such that the profile thereof is centered with respect to the profile of the first and second bevel surfaces 44 and 72 of the glass sheet 10, and used to grind the glass sheet 10 to remove the third portion 90 of the glass sheet 10, including the remainder of the end surface 20, as the glass sheet 10 passes, to form the apex surface 94. The rotating polish wheel 110 can be oriented similarly to the rotating grooved wheel 92, e.g. centered, and used to impart a desired finish quality to the edge of the glass sheet 10 and/or to round any sharp corners.

Figure 16:
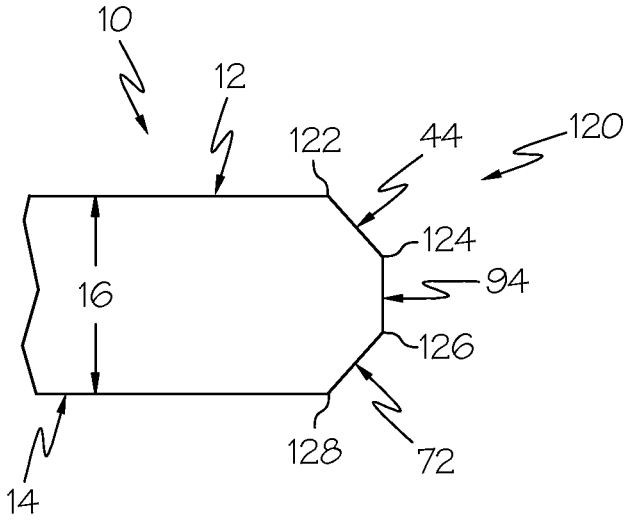
FIG. 16 is a schematic side view of a part of an example glass sheet including a first glass-sheet surface, a first bevel surface, an apex surface, a second bevel surface, and a second glass-sheet surface, and intersections therebetween, wherein the intersections are sharp.
Figure 17:
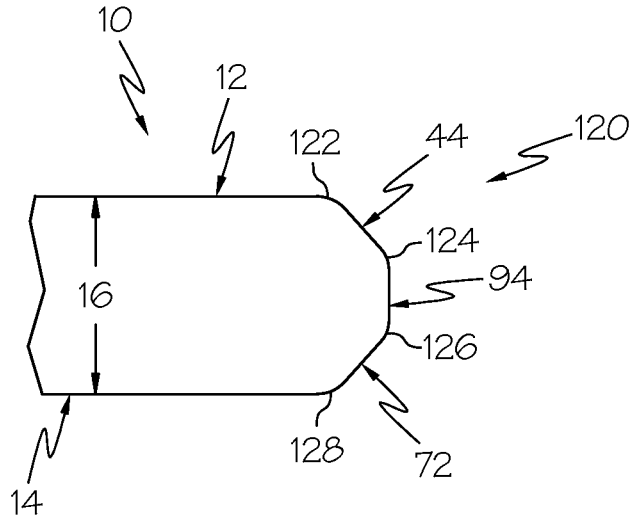
FIG. 17 is a schematic side view of a part of an example glass sheet including a first glass-sheet surface, a first bevel surface, an apex surface, a second bevel surface, and a second glass-sheet surface, and intersections therebetween, wherein the intersections are rounded.

In another aspect, a glass sheet 10 is provided, as shown in FIGS. 16-17. The glass sheet 10 includes a shaped edge 120 made in accordance with the above-described method, e.g. such that the median crack surface 22 thereof has been removed. Thus, the glass sheet 10 can include a first glass-sheet surface 12, a first bevel surface 44, an apex surface 94, a second bevel surface 72, and a second glass-sheet surface 14. The glass sheet 10 also can also include an intersection 122 between the first glass-sheet surface 12 and the first bevel surface 44, an intersection 124 between the first bevel surface 44 and the apex surface 94, an intersection 126 the apex surface 94 and the second bevel surface 72, and an intersection 128 between the second bevel surface 72 and the second glass-sheet surface 14. One or more of the surfaces can be, for example, polished. One or more of the intersections can be, for example, relatively sharp (e.g., see FIG. 16) and/or rounded to be free of relatively sharp intersections (e.g., see FIG. 17).

The glass sheet 10 including the shaped edge can exhibit a probability of failure of less than 5% at an edge stress of 135 MPa. The glass sheet 10 can be, for example, one that would be suitable for use in a liquid crystal display. The glass sheet 10 can have a thickness 16, for example, of 2 mm or less, e.g. 0.7 mm or less, 0.5 mm or less, or 0.3 mm or less. The glass sheet 10 can be free of coatings that might otherwise be used to strengthen the glass sheet 10, e.g. by increasing edge strength.

In another aspect, a method of shaping a glass sheet 10 is provided. The glass sheet 10 can be as described above, including and an edge portion 18 including an end surface 20 including a median crack surface 22, again as shown in FIG. 1.

The method can include a step (I) of removing a first portion 40 of the glass sheet 10 including a first edge 24 thereof, thereby forming a first bevel surface 44 between a first glass-sheet surface 12 and an end surface 20 of the glass sheet 10, again as shown in FIGS. 2-3. In some examples, step (I) can be carried out by use of at least one rotating cup wheel 42, or the like, as described above, and/or can be carried out at an angle with respect to the glass sheet 10 so as to control the angle of the first bevel surface 44, also as described above.

The method can also include a step (II) of removing a second portion 70 of the glass sheet 10 including a second edge 26 thereof, thereby forming a second bevel surface 72 between a second glass-sheet surface 14 and the end surface 20, again as shown in FIGS. 6-7. Like step (I), step (II) can also be carried out, in some examples, by use of at least one rotating cup wheel 42, or the like, and/or at an angle with respect to the glass sheet 10 so as to control the angle of the second bevel surface 72.

Steps (I) and (II) can be conducted simultaneously, sequentially, or in reverse order, also as described above.

The method can also include then a step (III) of removing a third portion 90 of the glass sheet 10 including the remainder of the end surface 20, thereby forming an apex surface 94 between the first and second bevel surfaces 44 and 72, again as shown in FIGS. 10-11. Removing the third portion can be carried out by use of a rotating grooved wheel 92, e.g. a formed groove wheel having a wheel-edge profile that is approximately complementary to the profile desired for the edge 100 of the glass sheet 10, or the like, as described above, and/or can be carried out to remove a minimal amount of the glass sheet 10 necessary to form the apex surface 94, also as described above. Step (III) can be carried out without removing material from the first or second bevel surface 44 or 72, also as described above.

In accordance with this method, step (I) and/or step (II) can remove the median crack surface 22, also as described above.

In another aspect, a glass sheet 10 is provided, again as shown in FIGS. 16-17. The glass sheet 10 includes a shaped edge 120 made in accordance with the above-described methods. The glass sheet 10 including the shaped edge 120 can exhibit a probability of failure of less than 5% at an edge stress of 135 MPa. Again, the glass sheet 10 can be one that would be suitable for use in a liquid crystal display, and can have a thickness 16 of 2 mm or less, e.g. 0.7 mm or less, 0.5 mm or less, or 0.3 mm or less.

Methods of the present invention can avoid excessive amounts of material being removed in a single step, thereby allowing a finger grit wheel to be used that can enhance edge quality. Moreover, removing the material in multiple steps can avoid grooved grinding wheels that may otherwise change in shape over time, thereby affecting the overall shape of the edge portion. In addition, use of the rotating cup wheel 42 to address the first and second portion to achieve the bevel surfaces helps manage glass particle generation and reduce the chances of machined glass particles from landing on the first or second glass-sheet surface that may otherwise negatively affect glass surface quality. Further still, the removal of material with the rotating cup wheel can provide sufficient clearance to allow machined glass particles to be freely removed from the vicinity of the glass sheet

EXAMPLES

Glass sheets were prepared in accordance with the methods disclosed herein. The dimensions of the glass sheets, as cut to size before shaping, were 400 mm×125 mm×0.5 mm. First and second bevel surfaces were formed at angles $\alpha$ and $\beta$, both of 70°, with respect to the corresponding edge portion of the glass sheet. The apex was formed to have an apex width of 0.3 mm. The first bevel surface, apex surface, and second bevel surface were then polished, and the intersections therebetween were rounded. The result was a glass sheet lacking a median crack surface and including a shaped edge.

Figure 18:
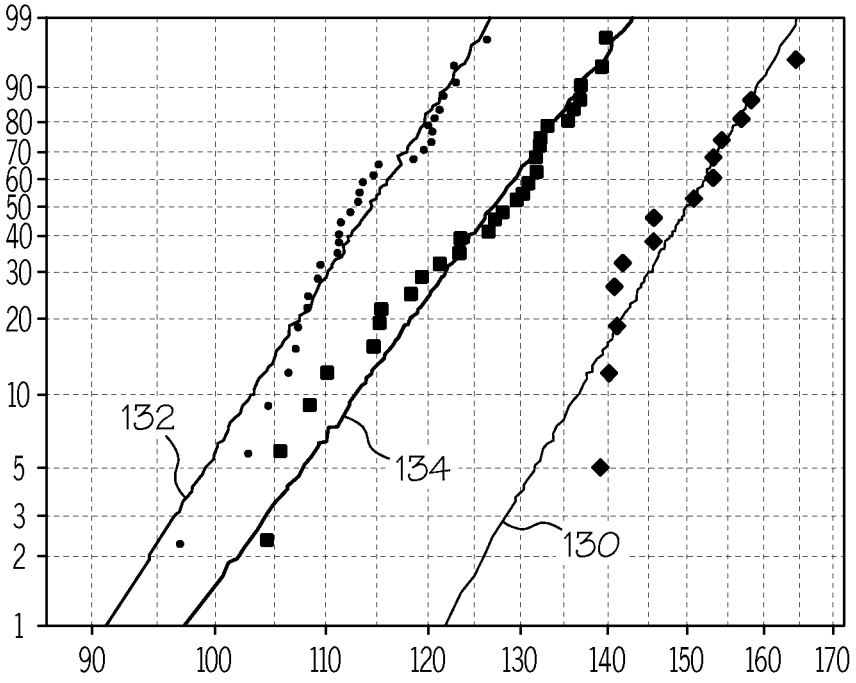
FIG. 18 shows results of an edge strength comparison according to Weibull expressed as a graph of probability of failure (%) versus failure stress (MPa), for a commercial process (circles), the process in SP11-142 (squares), and the process disclosed herein (diamonds).

FIG. 18 is a plot that shows edge strength results for the glass sheets prepared in accordance with these methods, in comparison to glass sheets prepared by an alternative approach. The vertical axis of the plot represents the probability of failure in (%) and the horizontal axis represents edge stress in (MPa). The process recipe can vary depending on the choice of tools, such as grinding wheels, and polishing wheels, bond material, and mesh size, and the choice of process parameters, such as material removal, and speed. As will be appreciated, variation and optimization of process parameters can lead to further improvements in performance. A four point bend test was performed on each glass sheet having edge portions prepared with techniques of the present disclosure as well as glass sheets having edge portions prepared with other techniques. The data represented as diamonds and by function 130 representing the data indicate probability of failure under different edge stress conditions with methods of the present disclosure. On the other hand, the data represented by circles and squares and respectively by functions 132, 134 representing the data indicate probability of failure under different edge stress conditions with methods of providing the edge portion without the methods of the present disclosure. As can be seen, the edge strength for the current process is significantly higher than for the illustrated alternative approach. Indeed, as indicated by function 130, a probability of failure of less than 75%, such as less than 60%, such as less than 50%, such as less than 40%, such as less than 30% such as less than 20% such as less than 10% such as less than 5% at an edge stress of 135 MPa can be achieved with methods of the present disclosure.

It will be apparent to those skilled in the art that various modifications and variations can be made without departing from the spirit and scope of the claimed invention.

What is claimed is:

1. A method of shaping a glass sheet comprising a first glass-sheet surface, a second glass-sheet surface opposing the first glass-sheet surface, a thickness defined between the first glass-sheet surface and the second glass-sheet surface, and an edge portion comprising an end surface comprising a median crack surface, wherein the first glass-sheet surface and the end surface intersect along a first edge of the edge portion, the second glass-sheet surface and the end surface intersect along a second edge of the edge portion, and the median crack surface extends from either the first or second edge of the edge portion along the end surface, the method comprising the steps of:

(I) removing a first portion of the glass sheet comprising the first edge with at least one rotating cup wheel, thereby forming a first bevel surface between the first glass-sheet surface and the end surface;

(II) removing a second portion of the glass sheet comprising the second edge with the at least one rotating cup wheel, thereby forming a second bevel surface between the second glass-sheet surface and the end surface; and then (III) removing a third portion of the glass sheet comprising a remainder of the end surface with a rotating grooved wheel to form an apex surface between the first and second bevel surfaces, wherein step (I) and/or step (II) removes the median crack surface, and wherein steps (I), (II) and (III) provide the glass sheet with a shaped edge that exhibits a probability of failure of less than 5% at an edge stress of 135 MPa.

2. The method of claim 1, wherein steps (I) and (II) are conducted simultaneously.

3. The method of claim 1, wherein the at least one rotating cup wheel of step (I) comprises a first rotating cup wheel and the at least one rotating cup wheel of step (II) comprises a second rotating cup wheel.

4. The method of claim 1, wherein the at least one rotating cup wheel is selected from the group consisting of a metal bond diamond wheel and a resin bond diamond wheel.

5. The method of claim 4, wherein the bonded diamond wheel includes a mesh size ranging from 400 to 1000.

6. The method of claim 1, wherein the grooved wheel is a metal bond wheel with a diamond mesh size ranging from 600 to 1000.

7. The method of claim 1, wherein the grooved wheel comprises a groove configured to accommodate a profile of the glass sheet defined by the first bevel surface, the apex surface, and the second bevel surface.

8. The method of claim 1, wherein, after step (III), further comprising the step (IV) of contacting the glass sheet with a rotating polish wheel to polish at least one of the first bevel surface, the apex surface, and the second bevel surface.

9. The method of claim 1, wherein, after step (III), further comprising the step (IV) of providing a rounded intersection between at least one of the first glass-sheet surface and the first bevel surface, the first bevel surface and the apex surface, the apex surface and the second bevel surface, and the second bevel surface and the second glass-sheet surface.

10. The method of claim 1, wherein, after step (III), further comprising the step (IV) of contacting the glass sheet with a rotating polish wheel including a wheel body selected from the group consisting of a rubber bond wheel, a resin bond wheel, and a polymer bond wheel and a cutting material selected from the group consisting of one or more of a diamond grit, a silicon carbide grit, an alumina grit and a ccria grit.

11. The method of claim 1, wherein the median crack surface extends less than or equal to 15% of the thickness of the glass sheet.

12. A method of shaping a glass sheet comprising a first glass-sheet surface, a second glass-sheet surface opposing the first glass-sheet surface, a thickness defined between the first glass-sheet surface and the second glass-sheet surface, and an edge portion comprising an end surface comprising a median crack surface, wherein the first glass-sheet surface and the end surface intersect along a first edge of the edge portion, the second glass-sheet surface and the end surface intersect along a second edge of the edge portion, and the median crack surface extends from either the first or second edge of the edge portion along the end surface, the method comprising the steps of:

(I) removing a first portion of the glass sheet comprising the first edge, thereby forming a first bevel surface between the first glass-sheet surface and the end surface;

(II) removing a second portion of the glass sheet comprising the second edge, thereby forming a second bevel surface between the second glass-sheet surface and the end surface; and then (III) removing a third portion of the glass sheet comprising a remainder of the end surface, thereby forming an apex surface between the first and second bevel surfaces, wherein step (I) and/or step (II) removes the median crack surface, and wherein steps (I), (II) and (III) provide the glass sheet with a shaped edge that exhibits a probability of failure of less than 5% at an edge stress of 135 MPa.

13. The method of claim 12, wherein steps (I) and (II) are conducted simultaneously.

14. The method of claim 12, wherein step (I) and/or step (II) includes chamfering with at least one rotating cup wheel.

15. The method of claim 12, wherein step (III) includes removing the third portion with a rotating grooved wheel.

* * * * *